US008113416B2

(12) United States Patent
Yan

(10) Patent No.: US 8,113,416 B2
(45) Date of Patent: Feb. 14, 2012

(54) HERMETICALLY SEALED PAPERBOARD CONTAINER WITH ENHANCED BARRIER PERFORMANCE

(75) Inventor: Zhiquan Yan, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 13/183,106

(22) Filed: Jul. 14, 2011

(65) Prior Publication Data

US 2011/0259943 A1 Oct. 27, 2011

Related U.S. Application Data

(63) Continuation of application No. PCT/US2010/035704, filed on May 21, 2010.

(60) Provisional application No. 61/180,143, filed on May 21, 2009.

(51) Int. Cl.
*B65D 3/28* (2006.01)

(52) U.S. Cl. ..... 229/198.2; 229/4.5; 229/5.84

(58) Field of Classification Search ..... 229/4.5, 229/5.5, 5.81, 5.84, 198.2, 400
See application file for complete search history.

(56) References Cited

U.S. PATENT DOCUMENTS

| | | | |
|---|---|---|---|
| 2,708,645 | A | 5/1955 | Norman |
| 2,759,656 | A | 8/1956 | Abrams |
| 2,853,222 | A | 9/1958 | Gallagher |
| 2,887,262 | A | 5/1959 | Rogers et al. |
| 2,934,453 | A | 4/1960 | Alsfeld et al. |
| 2,942,766 | A | 6/1960 | Ferris |
| 2,958,419 | A | 11/1960 | Kaelble et al. |
| 2,961,365 | A | 11/1960 | Sroog |
| 2,961,421 | A | 11/1960 | Cohen et al. |
| 3,028,798 | A | 4/1962 | Allen |
| 3,079,057 | A | 2/1963 | Colarusso |
| 3,144,971 | A | 8/1964 | Wommelsdorf |
| 3,181,765 | A | 5/1965 | Bonzagni et al. |
| 3,182,882 | A | 5/1965 | Aellen, Jr. et al. |
| 3,188,265 | A | 6/1965 | Charbonneau et al. |
| 3,580,464 | A | 5/1971 | Griffith |

(Continued)

FOREIGN PATENT DOCUMENTS

DE 3208682 9/1983

(Continued)

OTHER PUBLICATIONS

Jarvinen, J., "Advances in Airtight Paperboard Packaging," 2007 TAPPI European PLACE Conference (May 2007).

(Continued)

*Primary Examiner* — Gary Elkins
(74) *Attorney, Agent, or Firm* — MWV Intellectual Property Group

(57) ABSTRACT

A hermetically sealed paperboard container including a container body component including upper and lower ends, the body component being formed from a blank including a paperboard layer having first and second major sides, a first sealant layer on the first major side, a barrier layer on the second major side, and a second sealant layer on the barrier layer, wherein the blank includes first and second longitudinal ends, the first longitudinal end being skived to a predetermined thickness for a predetermined width, the skived portion being folded over onto the blank and heat-sealed to the first sealant layer to form a folded first longitudinal end, and wherein the body component includes an overlapped seam including the folded first longitudinal end positioned inside the second longitudinal end, a bottom component sealed to the lower end; and a lid component hermetically sealed to the upper end.

13 Claims, 6 Drawing Sheets

U.S. PATENT DOCUMENTS

| | | | | |
|---|---|---|---|---|
| 3,988,521 | A | 10/1976 | Fumel et al. | |
| 4,513,036 | A | 4/1985 | Thompson et al. | |
| 4,525,396 | A | 6/1985 | Takasa et al. | |
| 4,551,366 | A | 11/1985 | Maruhashi et al. | |
| 4,595,611 | A | 6/1986 | Quick et al. | |
| 4,617,211 | A | 10/1986 | Fries, Jr. | |
| 4,673,601 | A | 6/1987 | Lamping et al. | |
| 4,698,246 | A | 10/1987 | Gibbons et al. | |
| 4,715,527 | A * | 12/1987 | Tsuzuki et al. | 229/400 |
| 4,760,949 | A * | 8/1988 | Elias | 229/4.5 |
| 4,777,088 | A | 10/1988 | Thompson et al. | |
| 4,789,575 | A | 12/1988 | Gibbons et al. | |
| 4,835,025 | A | 5/1989 | Thompson et al. | |
| 4,894,267 | A | 1/1990 | Bettle, III et al. | |
| 5,084,284 | A | 1/1992 | McDilda et al. | |
| 5,236,408 | A | 8/1993 | McAdam, III et al. | |
| 5,330,845 | A | 7/1994 | Andersson et al. | |
| 5,620,135 | A | 4/1997 | Stahlecker et al. | |
| 5,725,917 | A | 3/1998 | Parks | |
| 5,810,243 | A | 9/1998 | DiPinto et al. | |
| 6,010,759 | A | 1/2000 | Yamada et al. | |
| 6,149,993 | A | 11/2000 | Parks et al. | |
| 6,190,485 | B1 | 2/2001 | Cahill et al. | |
| 6,302,321 | B1 | 10/2001 | Reese et al. | |
| 6,416,829 | B2 | 7/2002 | Breining et al. | |
| 6,554,182 | B1 | 4/2003 | Magnusson et al. | |
| 6,881,286 | B2 * | 4/2005 | Drummond et al. | 229/5.5 |
| 7,891,516 | B2 | 2/2011 | Takahashi | |
| 2004/0052987 | A1 | 3/2004 | Shetty et al. | |
| 2006/0286367 | A1 | 12/2006 | Fish et al. | |
| 2010/0003431 | A1 | 1/2010 | Raybuck | |
| 2010/0006567 | A1 * | 1/2010 | Cole | 219/730 |
| 2010/0019021 | A1 * | 1/2010 | Dixon-Garrett et al. | 229/4.5 |
| 2010/0137118 | A1 | 6/2010 | Chang | |

FOREIGN PATENT DOCUMENTS

| | | | | |
|---|---|---|---|---|
| DE | 4218393 | A1 * | 12/1993 | 229/5.81 |
| EP | 0166667 | | 1/1986 | |
| EP | 0583727 | | 2/1994 | |
| EP | 0960979 | | 12/1999 | |
| EP | 1418272 | | 5/2004 | |
| GB | 2055743 | | 3/1981 | |
| GB | 2435029 | | 8/2007 | |
| JP | 6-219440 | A * | 8/1994 | 229/198.2 |
| JP | 2003-221075 | | 8/2003 | |
| JP | 2006-233386 | | 9/2006 | |
| JP | 2007-39081 | | 2/2007 | |
| WO | WO-92/08652 | A1 * | 5/1992 | 229/5.81 |
| WO | 03/106277 | | 12/2003 | |
| WO | 2008/012395 | | 1/2008 | |
| WO | 2008/025996 | | 3/2008 | |

OTHER PUBLICATIONS

Brody, A., et al., "Development of a Hermetically Sealed Single Wall Paperboard Can System," 1984 Polymers, Laminations and Coatings Conference (1984) (abstract only).

Brody, A. L., "In-plant System Makers Spiral-bound Paper Can," *Snack Food* 73 (5), 40-41 (1984) (abstract only).

Potter et al., "Principles of Food Packaging," (1995) (abstract only).

Brody, A. et al., "Development of a Hermetically Sealed Single-Wall Paperboard Can System," TAPPI Polymers, Laminations and Coatings Conference (1984) (abstract only).

"Hermetically Sealed Paperboard Cans from Esselte Pac," *Tobacco J. Int.*, No. 6:487 (1983) (abstract only).

"Custom Moulded Lid Provides Ideal Follow-on for Heinz: New Moulded Lid for Heinz's Baby Food," *Retail Packaging*, Nov.-Dec. 2008, p. 7 (2008) (abstract only).

"Paper 'Cans' Join Bowater Range," *Soft Drinks Trade J.*, vol. 39, No. 12 (1985) (abstract only).

"Paper Cans," *Int. Pap. Board Ind.*, vol. 28, No. 9 (1985) (abstract only).

Brody et al., "Development of a Hermetically Sealed Single Wall Paperboard Can System," TAPPI 1984 Polymers, Laminations and Coatings Conference (1984) (abstract only).

"Hermetically Sealed Paperboard Cans from Esselte Pac," *Tobacco J. Int.*, No. 6:487 (1983) (abstract only).

* cited by examiner

HERMETICALLY SEALED PAPERBOARD CONTAINER WITH ENHANCED BARRIER PERFORMANCE

CROSS REFERENCE TO RELATED APPLICATION

This application is a continuation of International Patent Application No. PCT/US2010/035704 (pending) filed on May 21, 2010, which claims priority from U.S. Ser. No. 61/180,143 (expired) filed on May 21, 2009. The entire contents of PCT/US2010/035704 and U.S. Ser. No. 61/180,143 are incorporated herein by reference.

BACKGROUND

Paper-based containers with barrier properties are typically formed from a paper-based blank comprising a paperboard substrate and functionalized layers, such as oxygen and moisture barrier layers. The blank is die cut to the desired silhouette and then formed into a shape by wrapping it once around a mandrel. The overlapping ends of the blank form a straight seam having an underlying portion and an overlying portion. FIG. 1 shows a cross sectional view of the container body 100 made by overlapping ends of the blank 101 into a straight seam having an underlying portion 102 and an overlying portion 103. The raw edge 104 of the underlying portion of the seam is exposed to the container content, resulting in a reduction of the barrier performance of the container. Several techniques have been reported to prevent the raw edge 104 of the seam from being exposed to the packaged content.

One approach is to cover the exposed raw edge of the blank with a strip of barrier tape. Examples of materials used as a barrier tape to protect the raw edges of paperboard containers include metal foils, such as aluminum foil and tin foil, low density polyethylene (LDPE), ethylene-vinyl alcohol copolymer (EVOH), polyethylene terephthalate (PET), glycol modified PET, nylon, and combinations thereof. U.S. Pat. No. 5,620,135 discloses a technique for covering the raw edge of the body with a protective covering tape. The container body is formed from a blank having one longitudinal edge enclosed by a U-shaped protective covering. Prior to formation of the container body, the covered region of the blank is compressed to a reduced thickness such that the entire sheet segment, including the protective covering, has approximately the same thickness. PCT Application No. WO 2003/106277 discloses a single wrap container having the exposed underlying edge of the paper-based container body enclosed by a tape that comprises a layer of metalized PET interposed between layers of LDPE. The container body is formed from a blank comprising layers of, from the inside out, polyolefin, paper stock, polyolefin, metal foil, polyolefin, printed paper and overprint varnish. Using protective tapes to cover the raw edges, however, has several drawbacks. The adhered protective tape is an additional cost, and may be easily removed. Furthermore, an additional process is required to apply the protective tapes, resulting in further increase in cost and complexity of the manufacturing process.

Another approach commonly used in the multi-ply tubular container process is to fold the underlying edge portion of the barrier liner ply into an "anaconda" fold, wherein the underlying edge is folded back on itself and adhere to the overlying edge. An example of such a fold is illustrated in U.S. Pat. No. 5,084,284. The main drawback of an anaconda fold is the undesired increase in thickness of the seam, as it is three times the thickness of the blank. Cracks tend to form with such high thickness, resulting in a leakage of the contents, an influx of the outside air, and a reduction in barrier performance of the containers. Furthermore, such undesirably high thickness of the seam poses difficulties when attempting to hermetically seal the ends of the container body itself, as well as seal the top lid and bottom to the container body. To address the difficulty in folding the paper-based blank during the formation of the container body, several techniques have been used to reduce the thickness of the blank.

U.S. Pat. No. 6,190,485 teaches a technique of manufacturing a hermetically sealed spiral-wound multi-ply container without using an "anaconda" fold. The hollow body component of the hermetically-sealed container comprises a paperboard body ply and a liner ply on the inner surface of the body ply, wherein the inner ply includes a barrier layer and a layer of adhesive that is activatable at a predetermined activated temperature. A continuous body ply formed of paperboard having first and second side edges is advancing towards a shaping mandrel, while a continuous polymeric liner ply having first and second side edges is advancing adjacent to one surface of the paperboard body ply. The liner ply and the body ply are passed in face-to-face contact through a pair of nip rollers with the adhesive layer of the liner ply adjacent to the body ply, such that the first marginal edge of the liner ply extends beyond the first marginal edge of the body ply. The adhesive layer is then heated above its activated temperature so that the liner ply adheres directly to the inner surface body ply. The resulting adhered multi-ply is wrapped around the shaping mandrel such that the second marginal edge of the body ply engages the first marginal edge of the body ply, and the second marginal edge of the liner ply engages the first marginal edge of the liner ply. Finally, the first marginal edge of liner ply is heated to a temperature above the activated temperature of the adhesive so the second marginal edge adheres to the first marginal edge, resulting in a tubular shape that is subsequently cut into discrete lengths to provide the hollow body component of the hermetically sealed paperboard container. This process of producing hermetically sealed containers uses continuous webs of paperboard ply and liner ply, which require rather intensive handling, as well as relatively high shipping and storage costs.

Another approach of protecting the raw edge of the blank is "skiving and hemming," as described in U.S. Pat. No. 5,236,408. Skiving is removing some amount (e.g., half) of the thickness of the paperboard from the side seam flap. Hemming is folding the skived area back onto itself and sealing the other edge over the hemmed area by heat or flame. This approach has been used for producing gable top cartons for the liquid packaging industry, as described in U.S. Pat. No. 5,810,243. While the raw edge of the vertical side seam of the carton is protected, special sealing techniques using sealing jaws are required, such as those described in International Patent Application Nos. WO 2008/025996 and WO 1990/009926, to seal the folded top and bottom flaps of a hermetically sealed carton.

Achieving a hermetically sealed barrier paperboard cup using the "skiving and hemming" approach is difficult on the paperboard cup forming machine, which is typically designed to produce liquid-tight containers with a top rim not designed for a gas tight seal. The increased thickness of the skived/hemmed edge area over the original paperboard provides an additional challenge in producing a hermetically sealed bottom in the area where the thick skived/hemmed seam meets the bottom in the overlapped area. The skived edge also substantially increases the abrupt step at the seam of the top rim formed by the overlapped ends of the blank, and the non-planar hill-like surface of the rim makes hermetically sealing the lidding membrane (film or paper) more difficult.

GB Patent Application No. 2055743 discloses a paper-based container comprising a hollow container body having a recessed structure on the upper and lower ends, a top lip positioned on the recessed top of the container body, and a bottom positioned on the recessed bottom. The hollow container body is produced by skiving one longitudinal end of a paper-based blank to substantially half its thickness for a predetermined width and then forming a longitudinal groove substantially at the center of the skived portion. A heat-resistant adhesive, such as vinyl acetate emulsion and the like, is applied to the skived portion, and the adhesive is irradiated with infrared rays to evaporate water contained therein. The skived portion is then folded about the groove so that the end face of the skived paper and the end face of the unskived portion contact each other. Subsequently, the container body is formed by adhering both longitudinal ends of the blank together in overlapping relation with the folded longitudinal end inside the other longitudinal end. The paper-based blank consists of, from the outside: a thermo plastic synthetic resin layer, a paper layer, an adhesive layer, a metal layer, a heat-resistant adhesive layer, and a thermoplastic synthetic resins layer. The top lid and bottom components may be made of the same or similar material as that for the body component. This process of producing a barrier container is, however, rather complicated and high cost due to the use of adhesives and the recessed structure of the upper and lower ends.

Up until the present disclosure, to the inventor's knowledge, hermetically sealed barrier paperboard cups have not been achieved commercially using the "skiving/hemming/flame sealing" approach without adhesives on regular cup forming machines.

Accordingly, there is still a need for hermetically sealed paperboard containers with enhanced barrier and seal performances that may be produced by a process that is more effective and economical using commercially available high-speed liquid packaging skiving/hemming/sealing equipment and cup forming machines without the use of adhesives. One advantage of such approach is the potential for the in-plant system, where skived blanks can be shipped flat to the packaging plant where the barrier cups are formed using in-plant cup forming machines.

It is further beneficial to have hermetically sealed paperboard containers with excellent barrier performance that do not require the use of metal foils to impart the barrier properties.

SUMMARY

A hermetically sealed paperboard container with enhanced barrier and seal performances is disclosed that may be produced by a more effective and economical process for the in-plant system. The presently disclosed process overcomes the known difficulties of producing hermetically sealed cups from skived/hemmed blanks with increased thickness on the seam using regular cup forming machines. The disclosed process involves a combination of barrier material structure, skived/hemmed side seam, and optimization of cup forming and lid sealing processes to eliminate any pinholes or gas leakage area without sacrificing seal strength. The disclosed container includes a container body component, a bottom, and a top lid hermetically sealed to the body component. The container body is formed from a blank comprising a paperboard having one surface coated with a first sealant layer and the opposite surface coated with a barrier layer, and a second sealant layer applied over the barrier layer. One longitudinal end of the blank is skived to a predetermined thickness for a predetermined width, folded over onto the blank, and sealed to form a folded longitudinal end with slightly increased thickness. Then, the folded longitudinal end of the blank is overlapped inside the other longitudinal end of the blank to form a body seam that is subsequently sealed to provide the hollow container body. A bottom end formed of the same barrier paperboard structure is attached at the bottom end of the container body. The bottom end has a downwardly directed skirt which secures the end to the container body wall by being folded and squeezed within an upturned edge of the body wall. As such, the bottom seal is formed of three plies of paperboard. A rim curl at the top of the container is formed to provide more container strength and better appearance. A lid of barrier material is applied over the rim of the container to form a hermetically sealed container for food packaging applications.

DETAILED DESCRIPTION

Figure 1:
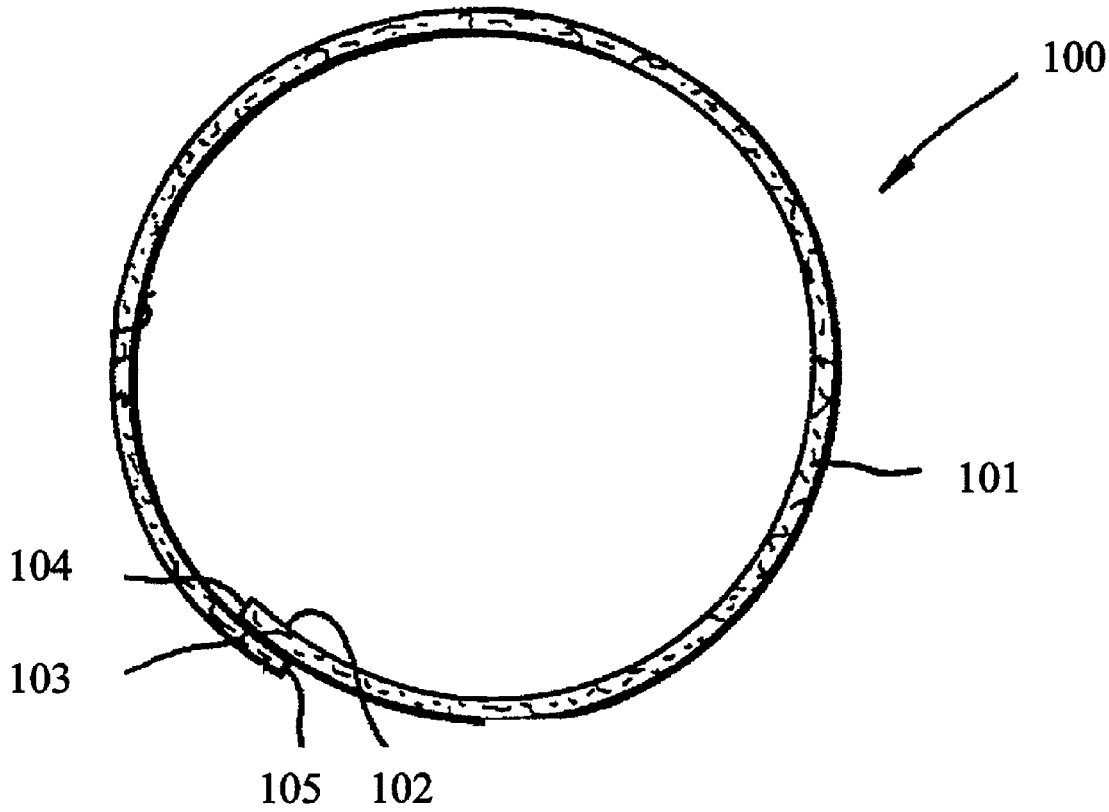
FIGURE 1 PRIOR ART
FIG. 1 shows a cross-sectional view of the paperboard container body of the prior art, wherein the overlapping ends of the blank form a seam with a raw edge exposed to the packaged content.

The present disclosure now will be described more fully hereinafter, but not all embodiments of the disclosure are necessarily shown. While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof.

The hermetically sealed paperboard container with enhanced barrier performance of the present disclosure includes:

(a) a container body component formed from a blank comprising:
  (i) paperboard having a first side and a second side,
  (ii) a first sealant layer on the first side of the paperboard,
  (iii) a barrier layer on the second side of the paperboard, and
  (iv) a second sealant layer applied over the barrier coating layer, (b) the blank having a first and a second longitudinal ends, the first end being skived to a predetermined thickness for a predetermined width, the skived portion being folded over onto the blank to form a folded first longitudinal end, the body component being further characterized by an overlapped seam with the folded first longitudinal end of the blank inside the second longitudinal end, (c) wherein the container body component includes an upper end and a lower end;

(d) a bottom component sealed to the lower end of the body component; and (e) a lid component hermetically sealed to the upper end of the body component.

The method of producing a hermetically sealed paperboard container of the present disclosure comprises steps of:

(1) producing a substrate characterized by:

(a) paperboard having a first side and a second side, (b) a first sealant layer on the first side of the paperboard, (c) a barrier layer on the second side of the paperboard, and (d) a second sealant layer applied over the barrier coating layer;

(2) cutting the substrate to a desired silhouette to provide a blank including a first and a second longitudinal ends;

(3) skiving the first longitudinal end of the blank to a predetermined thickness for a predetermined width;

(4) applying heat to the skived portion of the blank;

(5) folding the skived portion of the blank over onto the blank so that the first longitudinal end of the blank is folded;

(6) adhering both longitudinal ends of the blank together in overlapping relation with the folded first longitudinal end inside the second longitudinal end to form a container body component characterized by an upper end and a lower end;

(7) providing a bottom component;

(8) assembling the bottom component to the lower end of the container body component;

(9) providing a lid component; and

(10) hermetically sealing the lid component to the upper end of the container body component.

The Container Body Component

The container body component is formed from a blank that is made of a substrate including:

(a) paperboard having a first side and a second side;

(b) a first sealant layer on the first side of the paperboard;

(c) a barrier layer on the second side of the paperboard; and (d) a second sealant layer applied over the barrier coating layer.

A variety of paperboard may be used in the present disclosure. These include, but are not limited to, coated natural kraft board (CNK board), solid bleached sulfate board (SBS), solid unbleached sulfate board (SUS), coated recycled board (CRB), coated white lined chipboard (WLC), folding boxboard (FBB), and other paperboard grades suitable for cup formation.

Suitable sealant layers for use in the present disclosure include, but are not limited to, polyester; low density polyethylene (LDPE); high density polyethylene (HDPE); ethylene-vinyl acetate copolymer (EVA); ethylene methyl acrylate (EMA) copolymer; ionomer polymers such as poly(ethylene-co-methacrylic acid) (EMAA) copolymer SURLYN® commercially available from DuPont; and combinations thereof.

Barrier layers suitable for use in the present disclosure include, but are not limited to, nylon polymers, ethylene-vinyl alcohol copolymer (EVOH), polyethylene terephthalate (PET), materials derived from water-based barrier coatings, polyamide, polyvinylidene chloride, cyclic olefin copolymer, metalized polymer film, and combinations thereof. A variety of water-based barrier coatings known for imparting the barrier properties to paperboard may be used in the present disclosure to provide a barrier layer. When desired, the water-based barrier coatings may include nanoparticles to provide the tortuous effect that hinders the diffused molecules through the coating.

In one embodiment of the present disclosure, the water-based barrier coating composition comprises a polymeric binder, an amine stabilizer, and optionally filler particles, wherein the water-based composition has a pH of greater than or equal to pKa of the amine stabilizer. Examples of suitable fillers include, but are not limited to, layered fillers capable of being at least partially exfoliated such as bentonite, vermiculite, montmorillonite, smectite, kaoline; nanoparticle filler such as nanotalc particle; conventional low-cost fillers commonly used for the paper coating such as kaolin clay, talc, calcined clay, structured clay, ground calcium carbonate, precipitated calcium carbonate, titanium dioxide, aluminum trihydrate, satin white, silica, zinc oxide, and barium sulfate; and mixtures thereof. A variety of polymeric binders known for paper coating applications may be used. These include, but are not limited to, polyesters, styrene-acrylic polymers, styrene-butadiene polymers, vinyl-acrylic polymers, polyvinyl acetate, polyurethanes, polyacrylic acid, sodium polyacrylate, ammonium polyacrylate, sulfo-polyesters, urethane-acrylic copolymer, and combinations thereof. The water-based barrier coating composition may further include processability or functional additives which include, but are not limit to, colorants, pigments, defoaming agents, dispersing agents, tackifiers, surfactants, emulsifiers, coalescing agents, plasticizers, buffers, neutralizers, wetting agents, leveling agents, thickeners, rheology modifiers, biocides, waxes, water repellants, slip or mar aids, antioxidants, additive fillers, starch, and combinations thereof.

The sealant layers and the barrier layers may be applied to the substrate by any known methods. Examples of these applications include, but are not limited to, extrusion coating, extrusion laminate, curtain coating, and adhesive lamination.

The water-based barrier composition may be applied onto the substrate by any coating techniques commonly utilized in the paper coating applications, and may be applied either on-line during the paperboard making process or off-line. These techniques include, but are not limited to, size press application, brushing, spraying, roll coating, rod-coatings, dipping, spreading, printing methods, air knife coating, and curtain coating. When desired, the water-based barrier coating composition may be applied onto the paperboard on-line during the papermaking process to reduce both production cost and complexity.

Figure 2:
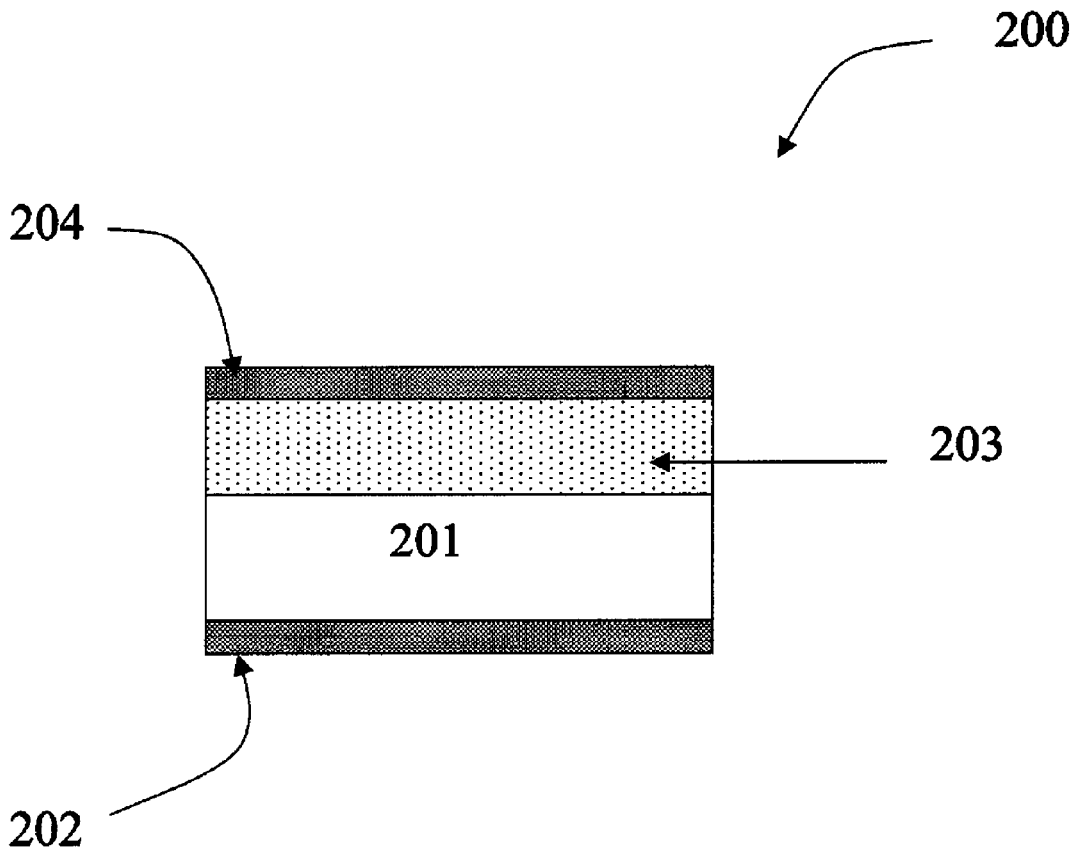
FIG. 2 shows one embodiment of the substrate used in the present disclosure, comprising a paperboard having one surface coated with a sealant layer and the opposite surface coated with a barrier layer, and a sealant layer applied over the barrier layer.

FIG. 2 shows one embodiment of the substrate suitable for use in the present disclosure. The substrate 200 is produced by coating one surface of the paperboard 201 with a sealant layer 202 and the opposite surface of the paperboard 201 with a barrier layer 203. Then, a layer of sealant 204 is applied over the barrier layer 203.

Figure 3:
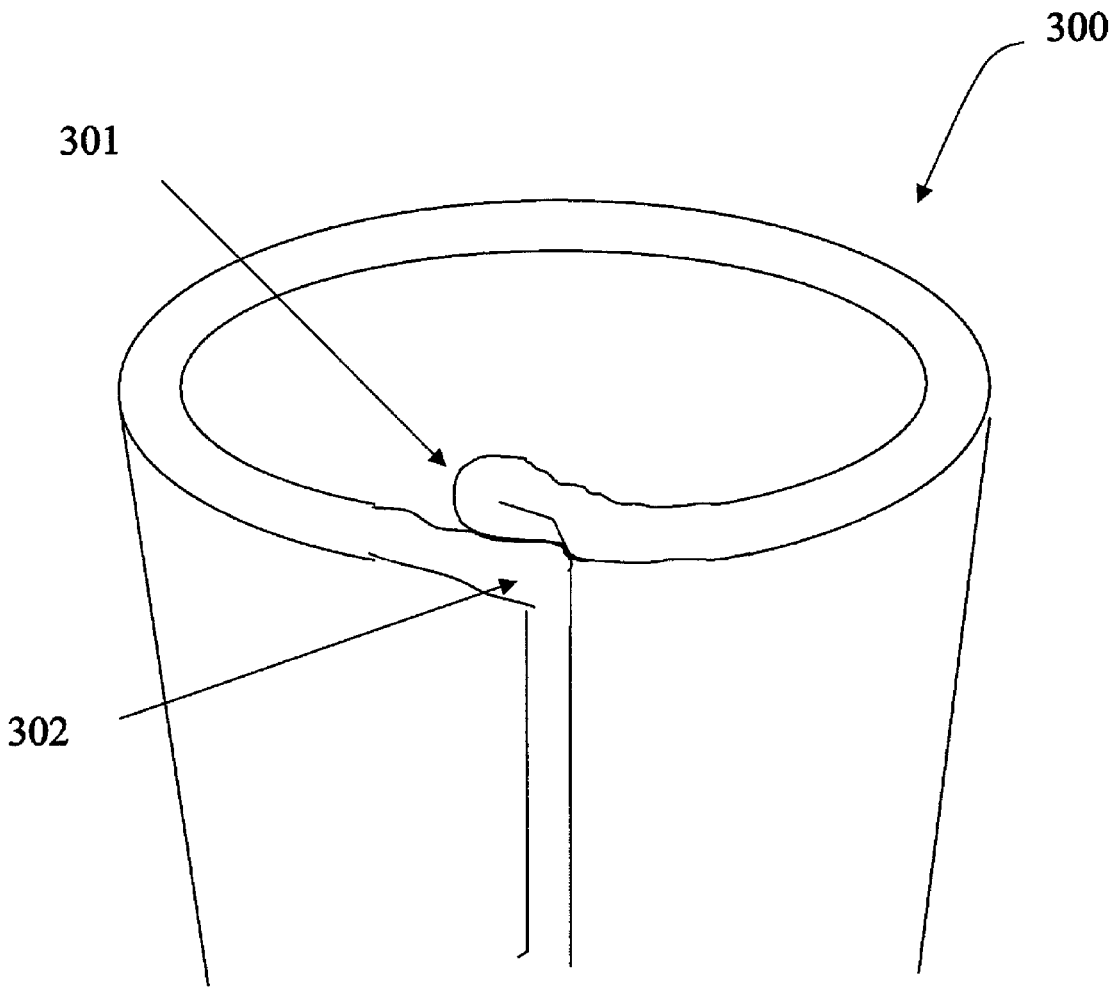
FIG. 3 shows a schematic illustration of the formation of a container body, wherein the folded longitudinal end of the blank is overlapped inside the other longitudinal end of the blank to form a body seam.
Figure 6:
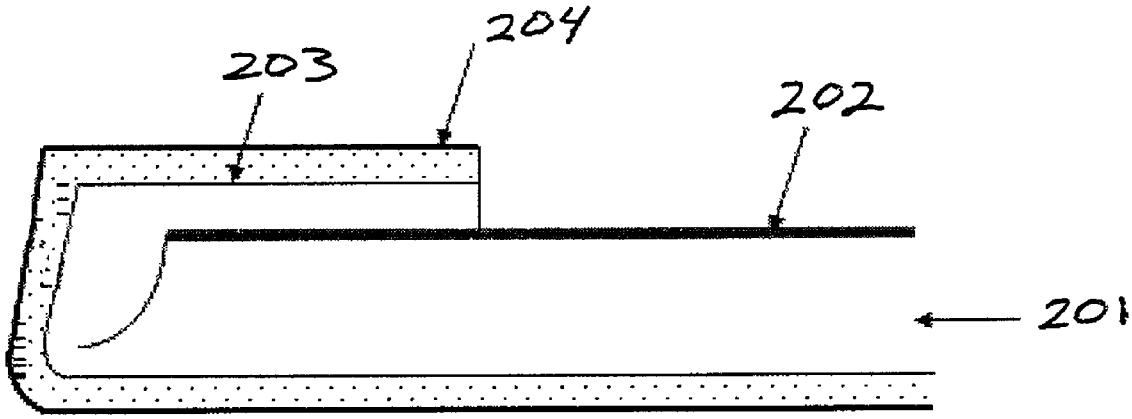
FIG. 6 shows a cross-sectional view of a skived and heat-sealed edge.

The substrate is die cut to a desired silhouette to provide a blank including a first longitudinal end and a second longitudinal end. The first longitudinal end of the blank is skived to a predetermined thickness for a predetermined width. The resulting skived end of the blank is treated with heat, then folded and sealed over the blank to provide the folded first longitudinal end, as shown in FIG. 6. As shown in FIG. 3, the container body component 300 is formed by overlapping both longitudinal ends of the blank such that the folded first longitudinal end 301 is inside the second longitudinal end 302, and subsequently the overlapped seam is sealed.

The Lid Component

The lid component may include a barrier paper-based substrate, a barrier polymeric film, or combinations thereof. In one embodiment of the present disclosure, the lid component comprises a paperboard, a barrier layer applied over the paperboard, and a sealant layer positioned over the barrier layer. When desired, the top lid component may be made of the same or similar material as that for the container body component. Several methods may be used for hermetically sealing the lid component to the container body component. Example of such hermetic seals include, but are not limited to, hermetically sealing the top with a plastic rim; a sealant bead dropped at the step-down area; a sealant bead added to the entire top rim before lidding; a lidding material with a heavy sealant such as those lidding films used for sealing barrier trays; a higher sealing pressure to press down lidding material to flatten the rim for maximum seal; and combinations thereof.

The Bottom Component

In one embodiment of the present disclosure, the bottom comprises a paperboard, a barrier layer applied over the paperboard, and a sealant layer positioned over the barrier layer. When desired, the bottom component may be made of the same or similar material as that for the container body component. The bottom may be assembled to the container body component by various sealing technologies. Examples of such sealing may include, but not limited to, hot air heat seal and ultrasound sealing. The sealing process may be optimized based on various factors. Some of these factors include, but are not limited to, the thickness of the sealant layer on the bottom; and the processing conditions such as lower sealing temperature to prevent the formation of pinhole, and higher sealing pressure to minimize the formation of gap between the bottom and the body component.

The Hermetically Sealed Paperboard Container

After formation of the container body component, the configuration of the upper and lower ends of the body may be constructed to support the sealing with the lid and the bottom components. Any known configurations for the upper and lower ends of the container body may be used in the present disclosure, and the selection of such configuration depends on the desired packaging applications of the container. Example of the configurations for the upper and lower ends of the container body include, but are not limited to, recessed structure, rolled bead, flange, and combinations thereof.

Figure 4:
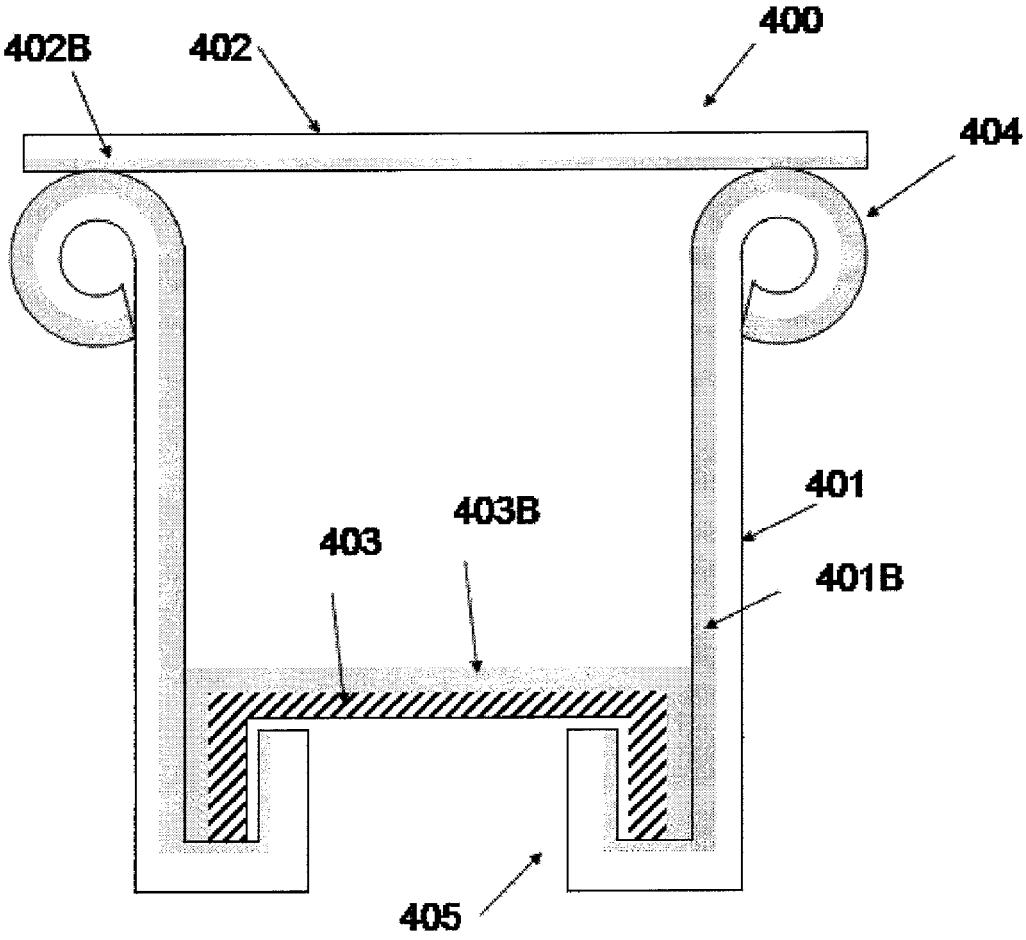
FIG. 4 shows one embodiment of the disclosed hermetically sealed paperboard container, comprising a container body component with a rolled rim on the upper end and a recessed configuration at the lower end, a top lid, and a bottom.

FIG. 4 shows one embodiment of the hermetically sealed paperboard container of the present disclosure. The container 400 includes a body component 401, a lid component 402, and a bottom component 403. The top end of the body 401 is rolled over so as to form a bead or flange 404, while the bottom end of the body 401 is constructed into a recessed configuration 405. The lid component 402 is hermetically sealed onto the upper end of the body 401 at the processing conditions that provide the adhesion between the sealant layer 402B of the lid component 402 and the sealant layer 401B of the body 401. The bottom 403 component is placed and sealed into the recessed end of the body 401 so that there is adhesion between the sealant layer 403B of the bottom component 403 and the sealant layer 401B of the body 401, and the sealant completely fills any gap between the bottom component 403 and the body 401.

The disclosed method of producing hermetically sealed paperboard containers utilizes the flat blanks of paperboard having functionalized coating layers, rather than continuous webs of paperboard ply and inner ply of functionalized layers. The flat blanks used in the present disclosure may be shipped and stored flat; therefore, a substantial savings may be achieved due to reduced storage and shipping costs. Furthermore, the handling efficiency during manufacturing production may be improved significantly because of the compactness of the flat blanks.

In one embodiment of the present disclosure, the barrier paperboard cups were made from paperboard blanks comprising layers of LDPE/paperboard/LDPE/EVOH/tie-layer/LDPE. The blanks were shaped into cups using a cup forming process. The paperboard blank structure and the thickness of each layer were critical for the formation of pin-hole free, hermetically sealed cups. In one example, the outer surface of a SBS paperboard substrate of 310 gsm (gram per square meter) was extrusion-coated with 35 gsm (1.5 mil thick) LDPE. The inner surface was coextrusion-coated with the following layers, starting from the paperboard: a 13-gsm layer of LDPE, a 10-gsm layer of EVOH, a 6.5-gsm tie-layer, and a 35-gsm layer of LDPE. The total coating thickness of the barrier layers on the inner surface of the paperboard was 2.7 mil. Same multilayer structure was used for the bottom component, except that the substrate used was a 220-gsm SBS paperboard.

The longitudinal end of the side wall blank that formed the inner side seam was skived to half of its thickness, folded, and then flame sealed to itself to provide raw edge protection. A high speed cup forming machine (e.g. model 1001 from Paper Machinery Corporation) was used to produce the barrier cups using the above materials and structures. The heat-molten polymer and pressure were used as means to secure the sidewall seam, and the bottom seal during the cup forming process.

The conventional cups formed from typical LDPE-coated cupstock or even barrier board substrates are known to provide unavoidable pin holes in LDPE layer during that heat sealing processing. The presence of pin-holes on the formed cups was acceptable for liquid-tight applications such as cold or hot drinks. However, these pinholes are not acceptable in packaging containers for gas-tight applications such as snack foods. The pin-hole formation in LDPE could be minimized by reducing an excessive heat, but seal strength would be compromised.

Figure 5:
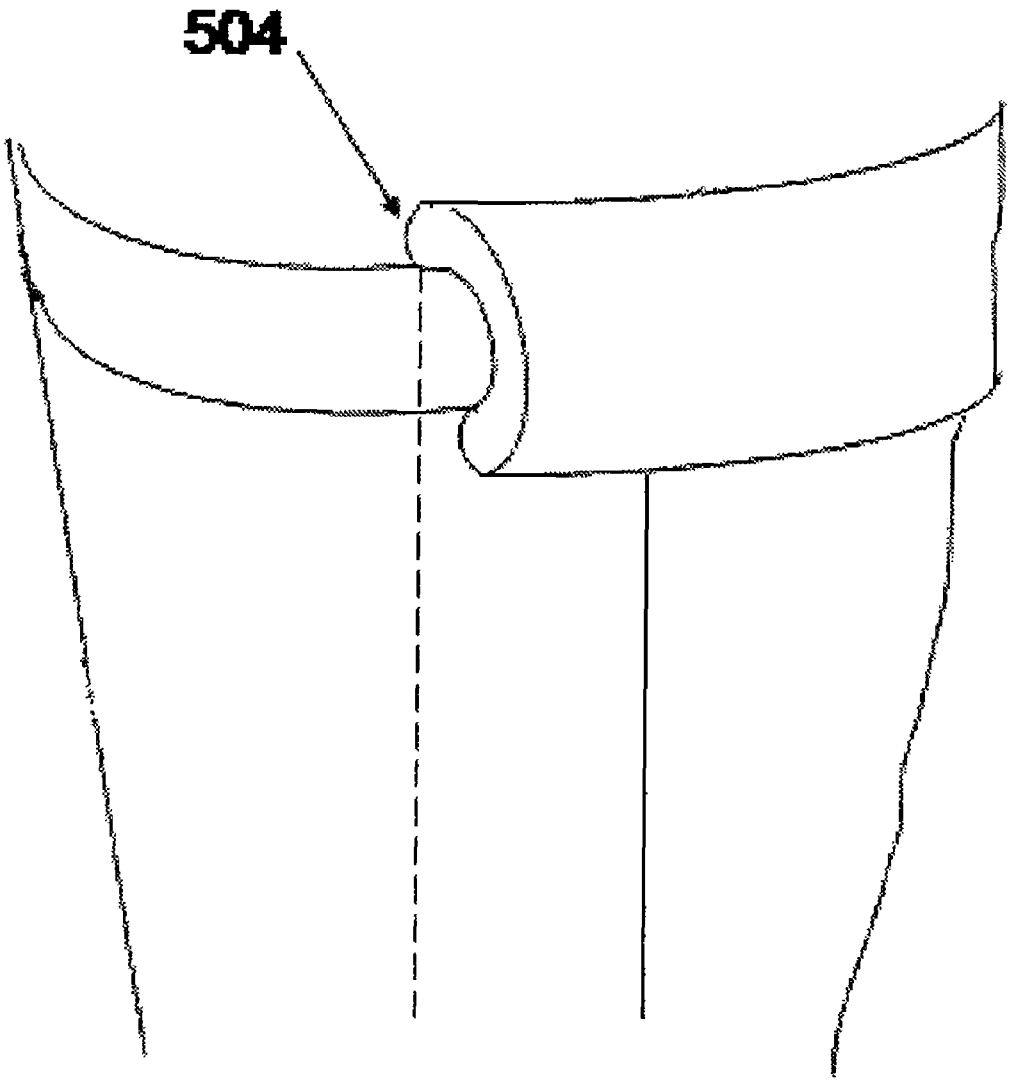
FIG. 5 shows a partial view of the skived side seam and the top rim curl of the disclosed hermetically sealed paperboard container, highlighting the step-down area in the rim.

The aforementioned known pin-hole formations may be eliminated in the hermetically sealed paperboard cups of the present disclosure. Surprisingly, a pin-hole free hermetically sealed cup could be achieved using the disclosed paperboard material even when the board structure comprises a predetermined barrier and heat-seal layers structure with certain thickness (total of 3 mils or more polymer layers preferred). It is believed that the absence of pinhole and the enhancement of hermetic seal performances of the disclosed paperboard cups may be due to the synergistic effect between several factors: the use of an improved barrier multilayer board structure with certain polymer thickness; the enhancement of skived/hemmed side seam, the optimization of cup forming process conditions such as a selected heat seal temperatures at which the oxygen-barrier layer remains intact and pin-hole free, and the lid sealing using barrier lidding material with certain polymer coating thickness and heat sealing conditions. In one embodiment, the thickness of the polymer coating is at least 3 mils. To form a hermetic lid seal over the rolled rim of the container, particularly over the step-down area (504 in FIG. 5) to avoid any leakage, platen head heat sealing equipment with flat carrier supporting the rim of the container may be used. A gas-tight seal may be formed using barrier lidding films such as the film made from 60 lb paper/48 BON/1.5 mil sealant that is commercially available from Momar Industries with 2 seconds seal time at 165° C. and 2.8 $kg/cm^2$ seal pressure on the sealing machine.

In one exemplary embodiment, a 12-ounce round hermetically sealed cup with a package surface area of 0.03 $m^2$ was formed using the aforementioned materials and procedure. The oxygen transmission rate (OTR) of the hermetically sealed cups of the present disclosure was measured and compared to those of the two controls: the conventional cup with LDPE layer, and the barrier cup with EVOH barrier layer but without skived side seam. The OTR measurement was performed at 23° C. and 0% relative humidity using an oxygen transmission analyzer commercially available from Mocon Inc. The OTR measurement of the disclosed hermetically sealed cup was about 0.1 cc/package/day. In comparison, the OTR measurement of the control conventional cup was about 119 cc/package/day, and that of the barrier cup with EVOH barrier material but without skived side seam was about 20 cc/package/day. These results demonstrated the improved barrier performance of the disclosed hermetically sealed, skived cup.

In the present disclosure, the hermetically sealed cup that is pin-hole free may be produced without sacrificing seal integrity, by using a properly designed barrier material structure and optimized converting cup process conditions.

While the disclosure has been described by reference to various specific embodiments, it should be understood that numerous changes may be made within the spirit and scope of the inventive concepts described. It is intended that the disclosure not be limited to the described embodiments, but will have full scope defined by the language of the following claims.

What is claimed is:

1. A hermetically sealed paperboard container comprising:

(a) a container body component including an upper end and a lower end, the container body component being formed from a blank comprising:

a paperboard layer having a first major side and a second major side;

a first sealant layer on the first major side;

a barrier layer on the second major side; and a second sealant layer on the barrier layer, wherein the blank comprises a first longitudinal end and a second longitudinal end, the first longitudinal end being skived to a predetermined thickness for a predetermined width, the skived portion being folded over onto the blank and heat-sealed to the first sealant layer to form a folded first longitudinal end, wherein the container body component comprises an overlapped seam comprising the folded first longitudinal end positioned inside the second longitudinal end, and wherein the barrier layer comprises a member selected from the group consisting of materials derived from water-based barrier coatings, nylon polymers, ethylene-vinyl alcohol copolymer (EVOH), polyethylene terephthalate (PET), polyamide, polyvinylidene chloride, cyclic olefin copolymers, metalized polymer film, and combinations thereof;

(b) a bottom component hermetically heat-sealed to the lower end of the container body component; and (c) a lid component hermetically heat-sealed to the upper end of the container body component;

said container having an oxygen transmission rate of at most about 3.3 cc/sq. m/day at 23 degrees C. and 0 percent relative humidity.

2. The container of claim 1, wherein the first sealant layer comprises a material selected from the group consisting of polyester, low density polyethylene (LDPE), high density polyethylene (HDPE), ethylene-vinyl acetate copolymer (EVA), ethylene methyl acrylate (EMA), ionomer polymers, and combinations thereof.

3. The container of claim 1, wherein the second sealant layer comprises a material selected from the group consisting of polyester, low density polyethylene (LDPE), high density polyethylene (HDPE), ethylene-vinyl acetate copolymer (EVA), ethylene methyl acrylate (EMA), ionomer polymers, and combinations thereof.

4. The container of claim 1, wherein the barrier layer comprises a water-based barrier coating comprising nanoparticles.

5. The container of claim 4, wherein the water-based barrier coating comprises a polymeric binder and an amine stabilizer, the water-based barrier coating having a pH of greater than or equal to pKa of the amine stabilizer.

6. The container of claim 5, wherein the polymeric binder comprises a material selected from the group consisting of polyesters, styrene-acrylic polymers, styrene-butadiene polymers, vinyl-acrylic polymers, polyvinyl acetate, polyurethanes, polyacrylic acid, sodium polyacrylate, ammonium polyacrylate, sulfo-polyesters, urethane-acrylic copolymer, and combinations thereof.

7. The container of claim 1, wherein the bottom component comprises:

(i) a bottom component paperboard layer;

(ii) a bottom component barrier layer on the bottom component paperboard layer, the bottom component barrier layer comprising a member selected from the group consisting of materials derived from water-based barrier coatings, nylon polymers, ethylene-vinyl alcohol copolymer (EVOH), polyethylene terephthalate (PET), polyamide, polyvinylidene chloride, cyclic olefin copolymers, and combinations thereof; and (iii) a bottom component sealant layer applied over the bottom component barrier layer, the bottom component sealant layer comprising a material selected from the group consisting of polyester, low density polyethylene (LDPE), high density polyethylene (HDPE), ethylene-vinyl acetate copolymer (EVA), ethylene methyl acrylate (EMA), ionomer polymers, and combinations thereof.

8. The container of claim 7, wherein the bottom component barrier layer and the bottom component sealant layer comprise a bottom component layered structure on the bottom component paperboard layer, and wherein the bottom component layered structure has a layer thickness of at least 3 mils.

9. The container of claim 1, wherein the lid component comprises:

(i) a lid component paperboard layer;

(ii) a lid component barrier layer positioned on the lid component paperboard layer, the lid component barrier layer comprising a material selected from the group consisting of materials derived from water-based barrier coatings, nylon polymers, ethylene-vinyl alcohol copolymer (EVOH), polyethylene terephthalate (PET), polyamide, polyvinylidene chloride, cyclic olefin copolymers, and combinations thereof; and (iii) a lid component sealant layer applied over the lid component barrier layer, the lid component sealant layer comprising a material selected from the group consisting of polyester, low density polyethylene (LDPE), high density polyethylene (HDPE), ethylene-vinyl acetate copolymer (EVA), ethylene methyl acrylate (EMA), ionomer polymers, and combinations thereof.

10. The container of claim 9, wherein the lid component barrier layer and the lid component sealant layer comprise a lid component layered structure on the lid component paperboard layer, and wherein the lid component layered structure has a layer thickness of at least 3 mils.

11. The container of claim 1, wherein the lid component comprises a lidding film comprising a lidding film sealant layer, the lidding film sealant layer having a layer thickness of at least 1.5 mils.

12. The container of claim 1, wherein the barrier layer and the second sealant layer comprise a layered structure on the second major side of the paperboard layer, and wherein the layered structure has a layer thickness of at least 2.7 mils.

13. The container of claim 1, wherein the barrier layer and the second sealant layer comprise a layered structure on the second major side of the paperboard layer, and wherein the layered structure has a layer thickness of at least 3 mils.

* * * * *